United States Patent [19]

Schmalfeld et al.

[11] 3,960,543

[45] June 1, 1976

[54] PROCESS OF PRODUCING SELF-SUPPORTING BRIQUETTES FOR USE IN METALLURGICAL PROCESSES

[75] Inventors: Paul Schmalfeld, Bad Homburg; Dieter Sauter, Frankfurt am Main; Fred Erich Cappel, Sprendlingen, all of Germany

[73] Assignee: Metallgesellschaft Aktiengesellschaft, Frankfurt am Main, Germany

[22] Filed: July 1, 1974

[21] Appl. No.: 485,050

[30] Foreign Application Priority Data

July 13, 1973 Germany ..... 2335669

[52] U.S. Cl. ..... 75/3; 75/41

[51] Int. Cl.[2] ..... C21B 1/08

[58] Field of Search ..... 75/3, 41

[56] References Cited

UNITED STATES PATENTS

| | | | |
|---|---|---|---|
| 3,212,877 | 10/1965 | Rueckl | 75/3 |
| 3,308,219 | 3/1967 | Schmalfeld et al. | 75/3 |
| 3,753,683 | 8/1973 | Vlnaty | 75/3 |

*Primary Examiner*—M. J. Andrews

*Attorney, Agent, or Firm*—Burgess, Dinklage & Sprung

[57] ABSTRACT

Self-supporting compact bodies for use in metallurgical processes are made from fine-grained materials containing metal oxides, fine-grained caking coal and optionally other non-caking materials. The non-caking components, e.g., the fine-grained materials and other non-caking materials, are highly heated and mixed with the caking coal and the resulting mixture is briquetted when the coal is in a plastic state. Tar pitch, petroleum bitumen or the like is admixed with the fine-grained caking coal before it is mixed with the highly heated non-caking components. Briquettes formed in this fashion are characterized by improved crushing and abrasive strengths and improved high temperature strength.

12 Claims, No Drawings

PROCESS OF PRODUCING SELF-SUPPORTING BRIQUETTES FOR USE IN METALLURGICAL PROCESSES

BACKGROUND

This invention relates to a process for producing self-supporting compact bodies for use in a metallurgical process. Such bodies are made of particulate (fine grained) materials containing metal oxides, fine-grained caking coal and optionally other non-caking materials. The non-caking materials, (e.g., metal oxides and other non-caking materials) are highly heated and mixed with the caking coal and the mixture is briquetted when the coal is in a plastic state.

Self-supporting compact bodies for use in a metallurgical process are briquettes made from fine-grained or dust-like starting materials which can be reduced to metals and smelted without a separate or added supply of solid fuel. In this connection it is a special advantage that fine-grained ore, flotation concentrate, converter dust or the like, together with the fuel required for the reduction process, can be processed to form uniform particles, which are desirable for the reduction or smelting process and result in a charge having a substantially uniform particle size. During transportation, storage and further processing, the compact bodies must meet high requirements as regards crushing strength and abrasion resistance and they must have good dimensional stability at elevated temperatures.

Two basically different processes are known for briquetting fine-grained materials contining metal oxides. In the so-called cold-briquetting process, the fine-grained materials are mixed with binders, such as tar, bitumen or the like, in a solid or liquid state, without being preheated to elevated temperatures, and are then compacted and after-treated to coke the binders. In the second process, caking coal is used as a binder rather than tar, bitumen, etc. Certain kinds of coal soften and form a solid decomposition product generally known as coke at temperatures in the range from 350°–550°C. When softened, such coal can bond non-caking materials so that so-called hot briquettes can be made at suitable temperatures.

The quality of the hot briquettes depends not only on the nature of the starting materials and the conditions (such as temperature and pressure during compacting), but also on a sufficiently fast and uniform mixing of the components. Since fine-grained caking coal cannot be heated directly to the required temperature (because of its tendency to soften, stick and cake), it is usual to heat the non-caking components to a temperature, which is sufficiently above the required temperature so that a mixture at the required temperature will be obtained when the heated non-caking components are mixed with the caking coal which itself may be preheated. A suitable heat balance taking into consideration the quantities and specific heats of the components and the temperature to which the caking coal can be preheated allows calculation of the extent to which the non-caking components must be overheated.

There can be limits to the overheating of the non-caking materials and, in this case, the caking coal must be preheated close to its softening point. Mixing must be performed rapidly, intensely, and uniformly so as to avoid excessive heating of the caking coal in contact with the overheated non-caking components. Excessive heating of the caking coal causes it to lose its caking property and the ability to obtain a highly homogeneous mixture for a production of high-grade hot briquettes. Additionally, the mixing operation must not last too long because this adversely affects the caking property of the coal. For these reasons, a satisfactory mixing is required in view of the quality of the compact bodies and for the optimum utilization of the caking capacity of the caking coal.

In a known process for mixing high-temperature, fine-grained materials with caking coal, the mixing operation is performed in a carrier gas stream from which a mixture of the components is separated and subsequently briquetted (printed German application No. 1,180,344). In a development of this process, the starting components are heated to different temperatures because the non-softening component and the caking coal are introduced into a hot gas stream in succession, in its direction of flow. The non-softening component is separated from the hot gas stream before the caking coal is introduced and separately separated. Only thereafter are the separately separated components mixed in a separate unit (German Pat. No. 1,696,509). Finally, a mixer has been disclosed which is used to mix an overheated, non-caking component with preheated caking coal, whereafter the mixture can be cooled to a predetermined extent from an adjusted mixed temperature. The mixer has screws which rotate in the same sense and have a lens-shaped profile for a good revolving and continuous feeding of the material to be briquetted (German Pat. No. 1,252,623).

It has now been found that the known processes and apparatus do not produce satisfactory mixtures if the specific gravity of the non-caking component is much higher than that of the caking coal or if the non-caking component exceeds certain proportions. At the beginning of mixing the caking coal, depending on its preheating, is at a temperature, which is more or less below its softening point. It thus lacks at this point in time an adequate ability to bond the hot particles, which have a higher specific gravity. In addition, the coal swells as it is heated and releases volatile constitutents so that it temporarily has a lower density than in the cold and the difference between the specific gravities is even increased temporarily.

Because of this difference in specific gravities, accelerating forces in the mixer (gravitational field, cyclone) during the mixing operation result in a certain segregation into particles having lower and higher specific gravities, respectively, and this segregation is not eleiminated as the mixing operation proceeds. Zones or layers are thus formed in the mixture and have an adverse effect not only on the uniformity of the mixture but also on the temperature equalization.

SUMMARY

It is an object of the invention to overcome these difficulties during the mixing of particles having different specific gravities in the production of hot briquettes.

This object is accomplished in that tar pitch, petroleum bitumen or the like is admixed to the fine-grained caking coal before the same is mixed with the highly heated non-caking substances. It has been found that a separation of the particles having a higher specific gravity can be almost completely suppressed by these measures. This is apparently due to the fact that the addition of tar or the like to the caking coal imparts to it a binding property even at the beginning of the mixing operation and is thus sufficiently bonded to the heavier particles even below its "caking temperature." The resulting mixture has a medium specific gravity and is no longer susceptible to acclerating forces in the mixer. The measure according to the invention enables the rapid formation of a uniform mixture and a uniform mixed temperature is obtained more quickly. Above all, the crushing and abrasive strengths and the high-temperature strength of the compact bodies (briquettes) are decisively improved.

The last-mentioned results were not to be expected because it had previously been observed in the production of ore briquettes with an addition of tar or the like that the strength of the compact bodies is considerably reduced at elevated temperatures owing to insufficiently outgassed binder residues and the compact bodies then tend to burst. It is surprising that in the process according to the invention, the binder added to the coal is coked like the volatile constituents of the coal so that only coked residues of the tar, bitumen and the like and of the caking coal are left in the finished briquette.

DESCRIPTION

It has been found that tar pitch, petroleum bitumen or the like must be added in a quantity of 2–20%, preferably of 4–10% by weight. The required quantity depends on the nature of the starting materials. In case of a specific fine-grained ore, an addition of, e.g., 10% resulted in a sticky, non-trickling mix, which could be handled and briquetted only with difficulty. Without an addition of tar pitch, it was impossible or very difficult to mix these highly heated fine-grained ores and caking coal with each other and the resulting hot briquettes had only a moderate strength. An addition of 2% remained virtually without effect because it was apparently insufficient to ensure the required initial bond. In case of ore dust having a very large surface area, best results were produced if 15% by weight of tar pitch or petroleum bitumen were added.

An addition of tar pitch, petroleum bitumen or the like will be of special advantage if only coal having a lower caking capacity is available. In these cases, a sufficiently larger amount of additional binder must be admixed. Tar pitch from the conventional by-product oven coking process is most suitable. For the present hot brequetting process, any other tar pitch produced by the low-temperature carbonization or coking of coal is virtually equivalent. Even high-boiling residue produced from petroleum distiallation or cracking is highly suitable. Natural asphalt may also be used.

In an alternate emvodiment of the process, fine-grained, coke at a high temperature may be added as an additional non-caking material. Such coke is preferably recovered from highly reactive fuels, such as highly volatile gas, coal, lignite, brown coal, peat or wood, if the reactivity of the carbon in the hot briquette is to be improved.

The components required for metallurgical processing of the compact bodies, such as lime, fluorspar or the like are suitable admixed during the hot briquetting. Pulverized coal, carbon black, pulverized coke, wood charcoal or the like may also be admixed to the tar pitch, petroleum bitumen or the like to advantage because this improves the crushing and abrasive strength of the hot briquettes. Finally, it is possible in the process according to the invention to admix carbon in a total quantity, which is sufficient for the intended further processing of the compact bodies, which may involve, e.g., of a reduction according to a certain process, and an immediately following or separate smelting and after treatment of the liquid metal.

The fine-grained materials, which contain metal oxides are heated to 600°–900°C., preferably to 700°–800°C. Heating may be a effected in an entraining gas stream or in a fluidized bed. Alternatively, a trickling column may be used, in which the fine-grained ore descends downwardly with turbulence through a number of screen plates countercurrent to hot gases but does not form a fluidized bed. This heating of the fine-grained ores may be combined to advantage with a dehydration and/or decarbonization.

The temperature of the components to be heated is adjusted so that the mixture is heated to a temperature of 350°–550°C., preferably of 420°–500°C., and is briquetted at this temperature. Before the mixture is briquetted, it may be suitable to cool it to a temperature, which may be as much as 100°C. below the mixed temperature.

Mixing is preferably accomplished by a mixer having screws rotating in the same sense, such as has been described more fully in German Pat. No. 1,252,623. Such mixing mechanism may be provided in its second half with means for supplying water and/or steam for cooling the mixture.

It is usually of advantage to subject the briquettes to a subsequent heat treatment at temperatures up to 800°C., preferably between 550° and 650°C. As a result, the residual tar in the hot briquette is removed and, by experience, the crushing strength and abrasion resistance of the briquettes are increased. This is of special significance for the transportation and bin storage of the briquetts before they are charged into the reduction furnace.

The added tar pitch consists preferably entirely or in part of the high-boiling tar fraction, which is obtained when the caking coal is heated and in the production of coke.

The process according to the invention does not have only the advantages described above as regards the improvement of the mixing operation and of the heat economy and the quality of the compact bodies, but also permits a much more flexible hot briquetting as regards the quality of the starting materials and their quantitative composition as well as the admixing of additives and the adjustment of the desired carbon content in the briquettes. Moreover, the process of the invention permits an economic utilization of various materials, which are recycled in the metallurgical process, such as blast bitumen or the like to advantage because this improves the crushing and abrasive strength of the hot briquettes. Finally, it is possible in the process according to the invention to admix carbon in a total quantity, which is sufficient for the intended further processing of the compact bodies, which may involve, e.g., of a reduction according to a certain process, and an immediately following or separate smelting and after treatment of the liquid metal.

The fine-grained materials, which contain metal oxides are heated to 600°–900°C., preferably to 700°–800°C. Heating may be effected in an entraining gas stream or in a fluidized bed. Alternatively, a trickling column may be used, in which the fine-grain ore descends downwardly with turbulence through a number of screen plates countercurrent to hot gases but does not form a fluidized bed. This heating of the fine-grained ores may be combined to advantage with a dehydratation and/or decarbonization.

The temperature of the components to be heated is adjusted so that the mixture is heated to a temperature of 350°–550°C., preferably of 420°–500°C., and is briquetted at this temperature. Before the mixture is briquetted, it may be suitable to cool it to a temperature, which may be as much as 100°C. below the mixed temperature.

Mixing is preferably accomplished by a furnace flue dust, converter dust, roll scale and iron oxide recovered by the regeneration of spent pickling baths, whereas the utilization of such materials would be difficult otherwise.

It is of special advantage to reduce blast furnace flue dust and converter dust, which contain lead and zinc, in a fluidized bed or in an entraining gas stream, whereby lead and zinc are volatilized to a large extent and the reduced dusts at high temperature are supplied together with high-temperature fine-grained ore to the hot briquetting process.

The process is not restricted to the use of a well-caking coal, such as is required for the conventional by-product oven coking process but enables also the use of a coal having a medium or low caking capacity. Besides, it is not required to use tar pitch from the conventional by-product oven coking process. It is sufficient to use petroleum bitumen or tar pitch obtained by any low-temperature carbonization of coal in addition to the tar pitch obtained by the coking in the same plant and by the heating of the caking coal and the tar pitch.

The use of the process will not be explained further by the following examples which are not intended to otherwise limit the invention.

EXAMPLE 1

680 kilograms flotation concentrate of hematite are heated in a fluidized bed to about 700°C. A non-caking fine coal is subjected to low-temperature carbonization in a second fluidized bed to produce coke at about 650°C. Fine-grained caking coal is treated in a suspended particle dryer to produce a caking coal, which is at a temperature of about 90°C. and contains about 1% residual water.

The mixer having screws rotating in the same sense (e.g., in accordance with German Pat. No. 1,252,623) is supplied at its inlet end with 200 kilograms predried caking coal. Closely thereafter, 50 kilograms liquid tar pitch at a temperature of about 180°C. are added to the caking coal. 70 kilograms coke at about 650°C. are then fed to the mixture through a third inlet thereof. Behind a mixing path portion in a length of about one-fourth of the entire mixing path length, 680 kilograms hematite at a temperature of about 700°C. are admixed. The mixer mixes all components quickly and intensely and a mixed temperature of about 470°C. results. The entire mixing time is about 50 seconds. The mixture is in a crumbly, only slightly sticky state and falls into an intermediate container, which contains a vertical stirrer. After a residence time of about 2 minutes in said intermediate container, the mixture is continuously supplied to a double-roll press.

About 925 kilograms hot briquettes at a temperature of about 440°C. are produced and are fed to a shaft, in which they are heated to about 600°C. and are subsequently cooled. The finished hot briquettes thus produced in a quantity of about 915 kilograms have a carbon content of about 25% and a crushing strength of about 350 kilograms per square centimeter and may be directly fed to a blast furnace. They do not require a supply of additional coke.

EXAMPLE 2

520 kilograms fine-grained iron ore and 50 kilograms fine-grained lime are heated in a fluidized bed to about 660°C. In a second fluidized bed, blast furnace flue dust and converter dust are reduced at about 1050°C. so that mainly lead and zinc are volatilized. In a third fluidized bed, coke at a temperature of about 650°C. is produced from a non-caking fine-grained coal. Fine-grained coal having a medium caking capacity is dried in an entrained gas stream to serve as a caking component.

The mixer having shafts rotating in the same sense is fed at its inlet end with 180 kilograms dried coal as a caking component and with 10 kilograms fluorspar and closely thereafter with a mixture of 85 kilograms petroleum bitumen and 15 kilograms tar pitch produced by the heating of the used coal. Said mixture has a temperature of about 200°C. Behind a mixing path portion having a length of about one-fourth of the entire mixing path length, a mixture, which is at a temperature of about 660°C. and consists of 520 kilograms iron ore and 50 kilograms lime are supplied through a third inlet and 50 kilograms of a prereduced mixture, which is at a temperature of about 1050°C. and consists of blast furnace flue dust and converter dust are fed suitably at said third inlet 90 kilograms fine-grained coke at a temperature of about 650°C. are fed through a fifth inlet. The mixer effects an intense mixing and feeds the mixture at a temperature of about 460°C. into a stirring and distributing container, from which the mixture is supplied to a double-roll press.

About 892 kilograms hot briquettes are produced from 1000 kilograms of material supplied to the mixture. The heating of these hot briquettes to about 600°C. leaves 882 kilograms finished hot briquettes, which are adapted to be charged into a blast furnace and have a carbon content of about 24% and a crushing strength of about 330 kilograms per square centimenter.

The briquettes made in Examples 1 and 2 were generally egg-shaped to form a bed, which has a maximum interstitial volume.

The ore-coal briquettes made by the process contain the carbon required for the metallurgical processing and the required admixtures. For this reason, it is sufficient to supply only these briquettes to the blast furnace to form therein a charge consisting only of uniform particles. This will promote a large interstitial volume so that the resistance to flow presented by the charge is low and it is easily possible to operate the blast furnace with twice the blast rate for a given blast pressure loss so that the smelting rate in the blast furnace can be more than doubled in practice.

What is claimed is:

1. Process for preparing self-supporting briquettes containing fine-grained metal oxide and caking coal for use in a metallurgical process to reduce said metal oxide which comprises the steps of:

a. forming a premixture of the fine-grained caking coal and tar pitch or petroleum bitumen having a temperature less than the temperature of the mixture to be briquetted formed in step (b), said tar pitch or petroleum bitumen being added in an amount of 2–20 percent by weight based on the mixture briquetted;

b. mixing the premixture from (a) with fine-grained materials containing metal oxide, said materials having a temperature in the range of 600°–900°C thereby forming a mixture to be briquetted having a temperature in the range of 350° to 550°C;

c. feeding said mixture to a briquetting press and forming briquettes from said mixture.

2. Process of claim 1 wherein tar pitch or petroleum bitumen is added in step (a) in an amount of 4–10% by weight.

3. Process of claim 1 wherein the non-caking material mixed in step (b) contains fine-grained, high-temperature coke made from highly volatile, long-flaming gas coal, lignite, brown coal, peat, or wood.

4. Process of claim 1 wherein lime or fluorspar is admixed with the premixture in step (a).

5. Process of claim 1 wherein pulverized coal, carbon black, pulverized coke or wood charcoal are admixed with the premixture in step (a).

6. Process of claim 1 wherein the fine-grained non-caking materials containing metal oxide are heated to 700°–800°C before being admixed in step (b).

7. Process of claim 1 wherein the mixture to be briquetted is formed in step (b) having a temperature in the range of 420°–500°C, and is briquetted at this temperature range.

8. Process of claim 1 wherein a known mixer having screws rotating in the same direction is used for forming said mixture to be briquetted in step (b).

9. Process of claim 1 wherein the briquettes are subjected to subsequent heat treatment at temperatures up to 800°C.

10. Process of claim 9 wherein said subsequent heat treatment of the briquettes is performed at a temperature in the range of 500°–650°C.

11. Process of claim 1 wherein the tar pitch used in step (a) is produced by heating coal and in the production of coke.

12. Process of claim 1 wherein at least part of the metal oxide is blast furnace flue dust and converter dust, which has been reduced so as to be free of lead and zinc.

* * * * *